US005240159A

United States Patent [19]

Gregory

[11] Patent Number: 5,240,159

[45] Date of Patent: Aug. 31, 1993

[54] SHOULDER HARNESS FOR BACKPACK

[75] Inventor: Wayne B. Gregory, Temecula, Calif.

[73] Assignee: Bianchi International, Temecula, Calif.

[21] Appl. No.: 961,431

[22] Filed: Oct. 15, 1992

[51] Int. Cl.[5] ..... A45F 3/04

[52] U.S. Cl. ..... 224/209; 224/211; 224/264; 224/901

[58] Field of Search ..... 224/209, 215, 210, 211, 224/259, 261, 262, 264, 153, 901

[56] References Cited

U.S. PATENT DOCUMENTS 4,420,103 12/1983 Douglass ..... 224/209

5,181,638 1/1993 McHale ..... 224/209

OTHER PUBLICATIONS

1991 Gregory Dealer's Workbook, p. 21 only Issued Aug. 1991; Gregory Mountain Products.

*Primary Examiner*—Linda J. Sholl

*Attorney, Agent, or Firm*—Wagner & Middlebrook

[57] ABSTRACT

A shoulder harness for a backpack having a back panel, a carry bag attached to the back panel, and a pair of S-shaped elongated shoulder pads formed of a polyfoam pad molded to a cover of stretch material and backed with a fabric cover of Velcro loop material. A load control panel is sewed to one end of each shoulder pad and includes one surface of Velcro hook material which engages the loop material on the shoulder pads. A pair of load stabilizing straps are secured at several places to the load control panels and attached to stress members at the lower end of said back panel and to buckles at the top end of the back panel. A sternum strap is fastened to each of the stabilizing straps and may be adjusted to one of several levels as chosen by the wearer.

17 Claims, 3 Drawing Sheets

FIG. 3
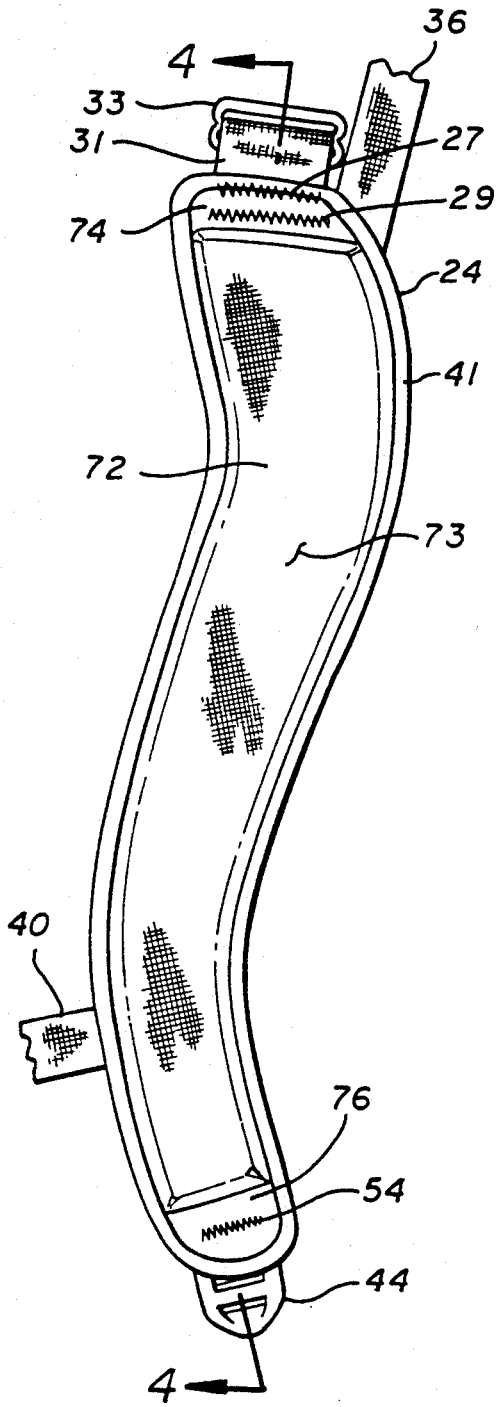
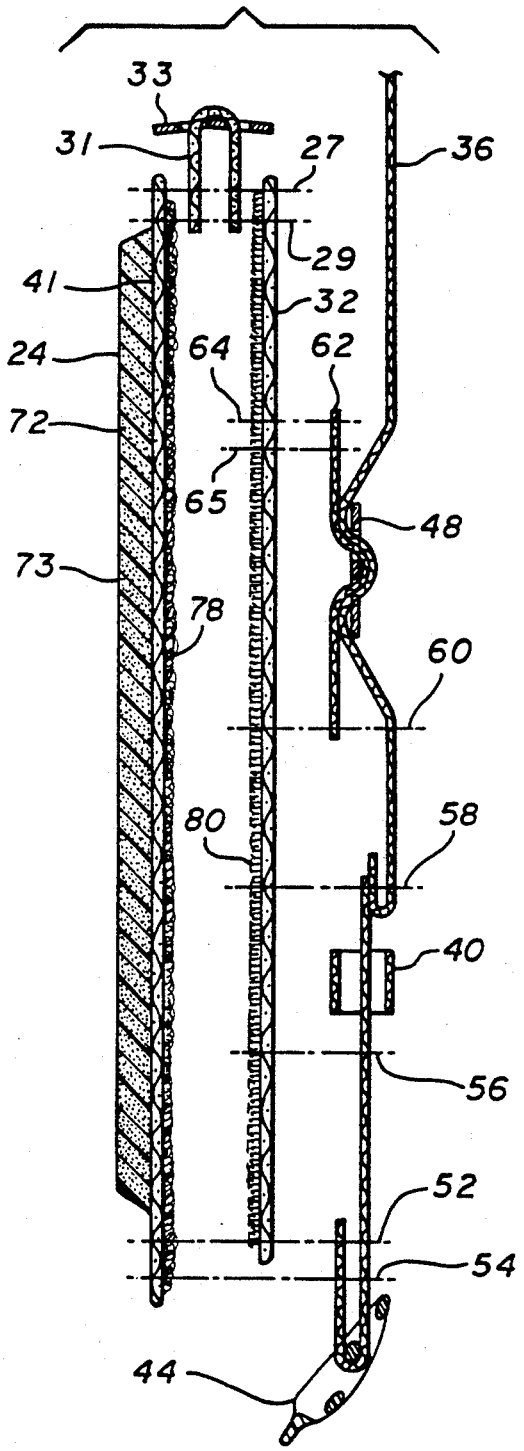
FIG. 4

SHOULDER HARNESS FOR BACKPACK

BACKGROUND OF THE INVENTION

Applicant has, for many years, been in the business of designing and manufacturing backpacks of many types including those designed for the heaviest loads. In connection with design and development of such large backpacks, there is a need to deal with means for carrying and distributing the load for maximum comfort of the wearer. While much of the weight is normally carried on the hips on padded waistband members, a certain amount is also carried on the shoulders. It has also been found desirable to provide means for shifting the proportion of weight from the hips to the shoulders and vice versa. In response to such requirements, applicant has designed backpacks incorporating a shoulder harness with padded shoulder pads and with stabilizing straps attached to the shoulder pads which are fastened to the waistband member and to the backpack above the attachment points for the shoulder straps.

The shoulder pads presently in use basically constitute sleeves of strong synthetic fabric which are filled with foam padding material. Means for attachment to the backpack including buckles, etc. are stitched to the fabric sleeve. A strip of Velcro hook type fastening material is stitched to one side of the pad and is stitched through the foam pad to the opposite side. Also sewed to the ends of the sleeves are load control panels of strong fabric having Velcro loop material on one side. These panels which engage the Velcro hook material carry most of the tension load which would otherwise be carried by the shoulder pad itself which would tend to stretch the pads and unduly compress the foam padding.

Securely stitched to one end of each of the sleeves and to the load control panels are stabilizing straps of webbing material. These straps are fastened at intervals along the length of the load control panels by means of spaced lateral seams which define anchoring points for a sternum strap which prevents the shoulder straps from slipping to the outside.

In use it has been found that the shoulder pad structure described above tends to bunch up and wrinkle the sleeve material creating pressure points against the wearer's shoulders. Over time this becomes somewhat uncomfortable and the wearer tends to try to move the pad around to shift the concentrated pressure points resulting from the wrinkles, etc. to different locations.

SUMMARY OF THE INVENTION

In an effort to improve the comfort of the above described structure, applicant has designed a new shoulder harness incorporating an improved shoulder pad in which polyfoam pad material is thermally molded to a stretch fabric cover and the assembly stitched to a back having a surface of Velcro loop material. Both the molded parts and the backing are of an elongated S-shape which provides a desirable contour over the wearer's shoulder and avoids lateral pressure and /or abrasion against the wearer's neck. A new load control panel is also generally S-shaped and includes Velcro hook material extending for essentially its entire area which engages the Velcro loop material on the back of the shoulder pad. The load control panel is thereby securely anchored to the shoulder pad and carries the tension load without requiring any stitching through the foam pad. The foam pad itself can be bent over severely without producing any wrinkling or bunching on its surface. Adjustable stabilizing straps of webbing material are sewed to the ends of the shoulder pads and to the ends of the load control panels. A plurality of spaced lateral seams extending along the load control panels for somewhat over half their length further attach the stabilizing straps to the load control panels and provide attachment means for a sternum strap. The stabilizing straps are attached to generally triangular members of strong fabric overlying the waistband at the lower end of the backpack and to fasteners on the upper part of the backpack.

DESCRIPTION OF THE DRAWINGS

FIG. 3 is a bottom view of a shoulder strap of FIG. 2; and

FIG. 4 is an exploded side view of a shoulder pad part of the harness with the parts shown separated.

DETAILED DESCRIPTION OF THE PREFERRED EMBODIMENT

Figure 1:
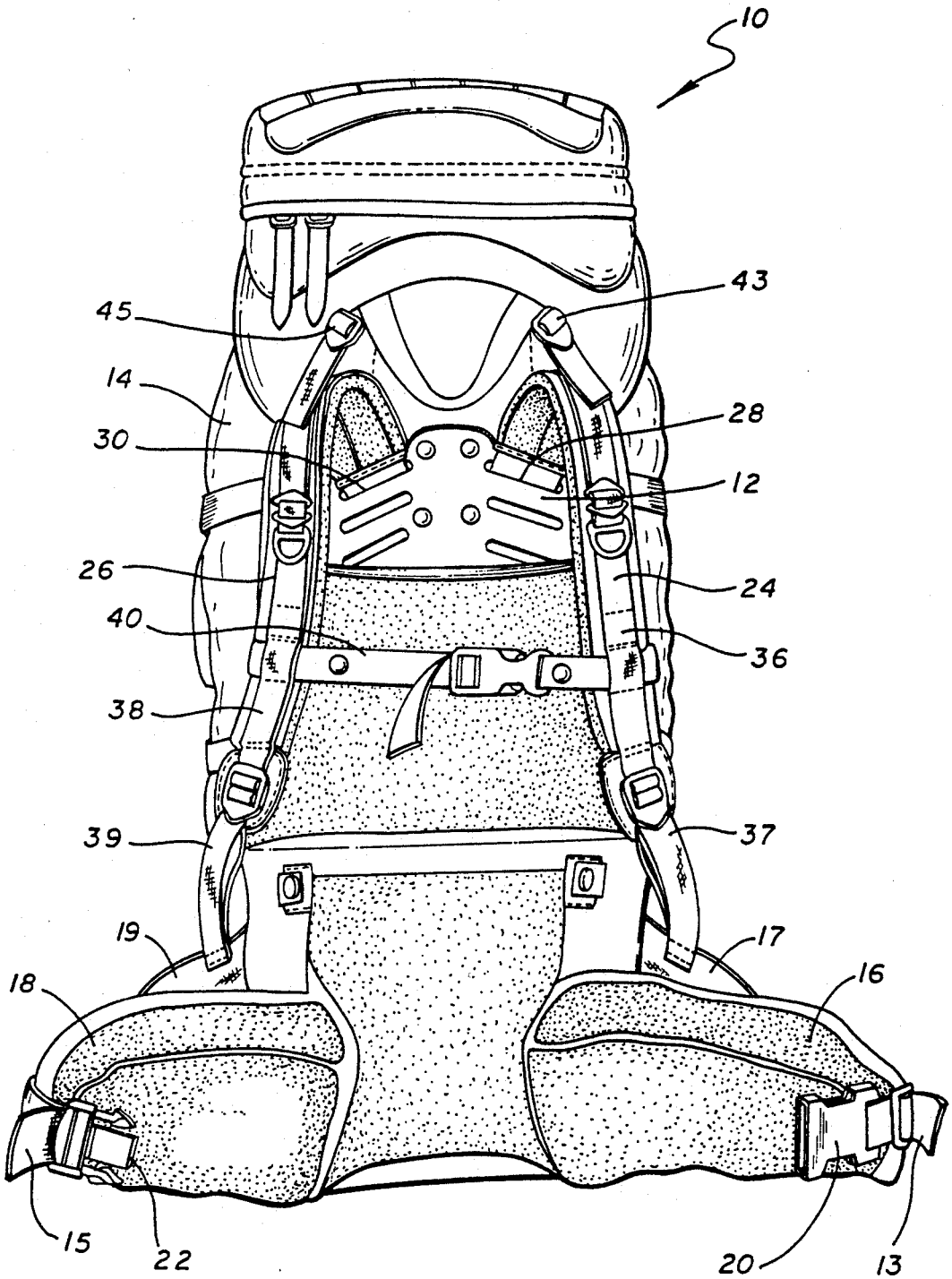
FIG. 1 is a front elevational view showing a backpack with the shoulder harness of the invention attached.

Referring to FIG. 1, a typical large backpack of current design is shown at numeral 10 including a back section including a back panel 12, a carry bag 14 fastened to back panel 12 and waistband members 16 and 18 which may or may not be formed as part of the back panel but are normally attached thereto. Various pockets and auxiliary carrying bags may be attached at various places to the backpack, none of which are involved in the present invention.

The waistband members 16 and 18 are pulled around the Wearer by webbing belt members 13 and 15 and are fastened at the front of the wearer by means of mating quick release buckle members 20 and 22, respectively. The shoulder harness of the invention includes a pair of shoulder pad members 24 and 26 which are fastened in slots 28 and 30 in the back panel 12 and to which are fastened a pair of load control panels 32 and 34 (not shown in this view) and stabilizing straps 36 and 38 which are connected to straps 37 and 39 from generally triangular stress members 17 and 19 of strong fabric which are attached to the lower end at back panel 12 and to buckles 43 and 45 attached to the upper end of back panel 12. A sternum strap 40 is normally connected between straps 36 and 38.

Figure 2:
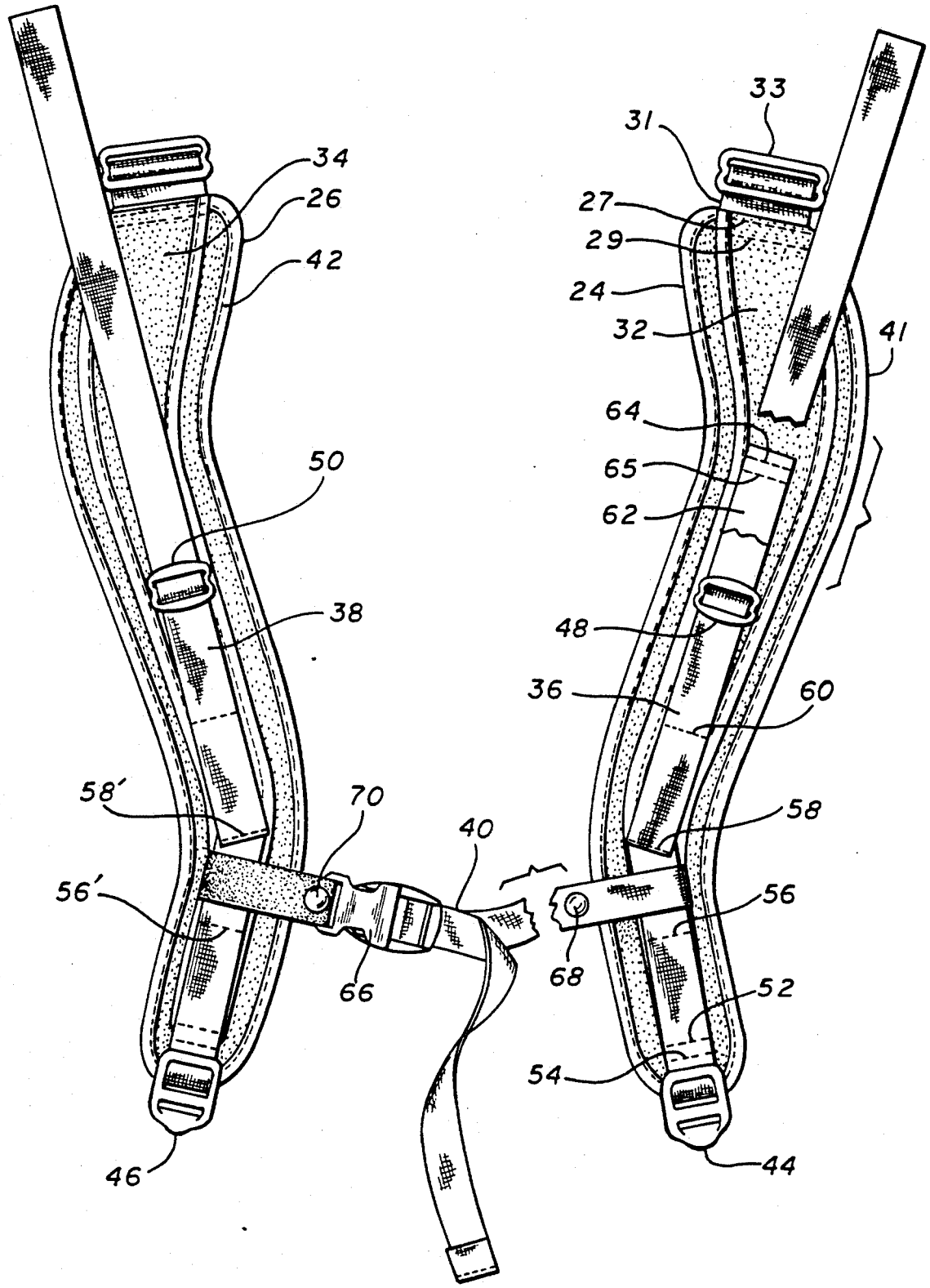
FIG. 2 is an enlarged front elevation of the shoulder harness.

FIG. 2 is a front elevational view of my backpack harness on an enlarged scale as compared to FIG. 1. In this view will be seen shoulder pads 24 and 26 having bindings 41 and 42, respectively, sewed around their edges. Sewed with a double row of stitches at the tops of shoulder pads 24 and 26 are load control panels 32 and 34 which are also secured to shoulder pads 24 and 26 over their entire area by means of Velcro fastening means described below. Secured at the top of shoulder pad 24 and load control panel 32 by means of stitching 27 and 29 is a loop of webbing 31 carrying a large figure-8 fastener 33 which passes through slot 28 in back panel 12 and thereby secures shoulder pad 24 and load control panel 32 to back panel 12. Unlike the shoulder pads which are capable of being stretched, the load control panels 32 and 34 do not stretch and therefore carry any tensile loads which might otherwise be transferred to the shoulder pads and tend to deform or stretch them.

Secured to the load control panels 32 and 34 are the stabilizing straps 36 and 38, including D-buckle fasteners 44 and 46 respectively, at their lower ends for fastening to straps on triangular stress members 17 and 19, and FIG. 8 slide members 48 and 50 respectively, for adjusting the length of straps 36 and 38 to control relative loading of the backpack between the hips and the shoulders. Because of the S-shape of the load control panels 32 and 34, it has proved desirable to form straps 36 and 38 in two sections sewn to the load control panels at a slight angle to each other. The lower part of stabilizing strap 36 is secured with one row of stitching 52 to the lower end of load control panel 32 and with a second row of stitching 54 to the lower end of shoulder pad member 24 below the foam padding material. Additional rows of lateral stitching 56 and 58 secure the lower end of strap 36 to the load control panel 32. Stitching 58 also secures the lower end of the upper part of strap 36 to the panel 32. An addition lateral row of stitching 60 is spaced about 2" (5 cm) above row 58. A stub strap 62 is sewed to the load control panel 32 at stitching 64 and 65 and carries the FIG. 8 slide member 48 which provides means for adjusting strap 36.

The top end of strap 36 connects to buckle 43 (FIG. 1) attached to the back panel 12. Shoulder pad 26, load control panel 34 and stabilizing strap 38 are essentially as described, this assembly being essentially a mirror image of that described in connection with shoulder pad 24. The spaces between stitching rows 52, 56, 58 and 60 as well as the space between rows 60 and 64 may all be used for locating the sternum strap 40. As shown the sternum strap 40 is attached to stabilizing strap 36 between stitching rows 56 and 58 and between corresponding stitching rows 56' and 58' on stabilizing strap 38. The sternum strap itself includes a quick release buckle 66 and each end thereof is looped over one of straps 36 and 38 and fastened to itself by means of heavy snap fasteners 68 and 70.

FIG. 3 is a view of shoulder pad 24 from the bottom or opposite side from that shown in FIG. 2. The foam member consists of an S-shaped strip of polyfoam material 72 to which is attached, by thermal molding, a layer of synthetic stretch fabric 73, so that these parts are one unitary pad. The polyfoam padding material itself extends to essentially the entire area of the shoulder pad 24 itself except for a short section 74 at the top end to which the load control panel 36 and webbing member 31 are stitched, and a similar short section 76 at the bottom end to which the lower part of stabilizing strap 36 is stitched. In this view, one sees the opposite side of stitching seams 54, 27 and 29.

FIG. 4 is an exploded side view, mostly in section, of the shoulder pad 24 showing the individual parts separated and with the stitching shown as construction lines through the respective parts. Beginning at the bottom lay ®r which is the molded pad 72 covered with stretch fabric 73 and moving generally to the right, the back side or upper side of pad 24 is a fabric layer 78 of Velcro loop or pile fabric. Layers 78 and 72 are bound together by means of a binding 41. Fastened at the top of strap 24 is the short piece of webbing material 31 which is folded back on itself to capture the FIG. 8 fastener 33 and the top edge of the load control panel 32 by means of stitching seams 27 and 29. Panel 32 has, on its surface facing the loop or pile material 78, a layer of Velcro hook material 80. Since load control panel 32 has most of its entire area in hook material in contact with the loop or pile material 78 and is otherwise secured by stitching at numerals 27 and 29, and since the normal force on panel 32 is in a direction to stretch panel 32 rather than to peel it away from the loop or pile material 78, there is no tendency for members 24 and 32 to separate in use, rather, the load control panel is held tightly against pad 24 and carries the forces in tension which might otherwise tend to stretch and deform the shoulder pad 24.

Another short section of webbing 62 captures the FIG. 8 slide member 48 and is stitched to the load control panel 32 at numerals 64 and 65, and, along with stabilizing strap 36 at stitch line 60. The upper part of strap 36 is also fastened to the lower part thereof and to load control panel 32 at stitch line 58. The lower part of strap 36 is also stitched to panel 32 at stitch lines 56 and 52. The end of this lower strap is folded over, capturing the D-buckle fastener 44 and is stitched to the end of pad 24 at stitch line 54 and to both of pad 24 and load control panel 32 at stitch line 52.

The above described embodiments of the present invention are merely descriptive of its principles and are not to be considered limiting. The scope of the present invention instead shall be determined from the scope of the following claims including their equivalents.

What is claimed is:

1. A shoulder harness for a backpack including a back section including a back panel, a carry bag attached to said back panel and stress members attached to said back panel;

said shoulder harness comprising a pair of generally S-shaped elongated polyfoam shoulder pads and a cover of stretch fabric molded to each said polyfoam pad, and a cover including one of hook and loop fastening material fastened to the opposite side of each said polyfoam pad from said stretch fabric;

an elongated S-shaped load control panel having the other of said hook and loop fastening material fastened to one side thereof engaging said fastening material on each of said shoulder pads, said load control panels being stitched to said shoulder pads on one end thereof: and stabilizing straps of webbing material sewed to said load control panels and said shoulder pads, including a plurality of spaced lateral seams and means for attaching said stabilizing straps to said stress members and to the upper end of said back panel.

2. A shoulder harness as claimed in claim 1 wherein said harness includes a sternum strap and said sternum strap is attached to said stabilizing straps between pairs of said spaced lateral seams.

3. A shoulder harness in accordance with claim 1 wherein said load control panels are stitched to the upper ends of said shoulder pads.

4. A shoulder harness in accordance with claim 1 wherein said back panel includes a plurality of spaced anchoring slots, a flattened figure eight fastener is attached at the upper end of each of said shoulder pads;

said FIG. eight fasteners being adapted to be inserted into selected ones of said anchoring slots and turned to fasten said shoulder pads to said back panel.

5. A shoulder harness as claimed in claim 1 wherein an additional short length of ebbing is stitched to each said load control panel, a figure eight slide buckle is captured in each said short length of webbing a said stabilizing straps are fed through said FIG. 8 slide member.

6. A shoulder harness as claimed in claim 1 wherein said spaced lateral seams extend from the lower end of said shoulder pad to a point more than half the distance to the upper end of said load control panel.

7. For use with a backpack including a back panel, a carrying bag attached to said back panel, generally triangular stress members attached to the lower part of said back panel, and a shoulder harness attached to said back panel:

said shoulder harness comprising a pair of generally S-shaped elongated polyfoam pads, a cover of synthetic stretch fabric molded to each said polyfoam pad, a cover of Velcro loop fastening material fastened to the opposite side of each said polyfoam pad, said cover of stretch fabric and said cover of Velcro loop material extending on their ends slightly beyond said polyfoam pads, and binding means stitched around the periphery of said shoulder pads;

generally S-shaped load control panels each having Velcro hook fastening materials over substantially its area on one side engaging said Velcro loop fastening material on each of said shoulder pads, said load control panels being stitched to said shoulder pads on one and thereof;

stabilizing straps of webbing material sewed to said load control panels including a plurality of spaced lateral seams, said spaced lateral seams extending from the lower end of said shoulder pads and said load control panels to somewhat over half the length of said load control panels from their lower end, attachment means at the lower end of said stabilizing straps for attachment to said generally triangular stress members, the upper end of said stabilizing straps being adapted for attachment to the upper end of said back panel.

8. A shoulder harness in accordance with claim 7 wherein said load control panels are stitched to the upper ends of said shoulder pads.

9. A shoulder harness as claimed in claim 7 wherein said harness includes a sternum strap and said sternum strap is attached to said stabilizing straps between pairs of said spaced lateral seams.

10. A shoulder harness in accordance with claim 7 wherein said back panel includes a plurality of spaced anchoring slots, a flattened FIG. 8 fastener is attached at the upper end of each of said shoulder pads;

said FIG. 8 fasteners being adapted to be inserted into selected ones of said anchoring slots and turned to fasten said shoulder pads to said back panel.

11. A shoulder harness as claimed in claim 7 wherein said spaced lateral seams extend from the lower end of said shoulder pad to a point more than half the distance to the upper end of said load control panel.

12. A shoulder harness for a backpack including a back panel having upper and lower parts, a carry bag attached to said back panel, and means attaching said shoulder harness to said back panel:

said shoulder harness comprising a pair of elongated polyfoam shoulder pads each having a cover of stretch fabric molded thereto and a cover including one of loop and hook fastening material fastened to the opposite side of each said polyfoam pad from said stretch fabric cover, an elongated load control panel having the other of said hook and loop fastening material fastened to one side thereof engaging said fastening material on each of said shoulder pads, said load control panels being stitched to said shoulder pads on one end thereof; and stabilizing straps sewed to said load control panels and to said shoulder pads and means for attaching said stabilizing straps to said backpack.

13. A shoulder harness in accordance with claim 12 wherein stress members are attached to the lower part of said back panel and said stabilizing straps are attached to said stress members and to the upper part of said back panel.

14. A shoulder harness as claimed in claim 12 wherein an additional short length of webbing is stitched to each said load control panel, a figure eight slide buckle is captured in each said short length of webbing and said stabilizing straps are fed through said FIG. 8 slide member.

15. A shoulder harness for a backpack including a back panel having upper and lower parts, a carry bag attached to said back panel, means for attaching said shoulder harness to said back panel and a pair of shoulder pads forming part of said shoulder harness:

each said shoulder pad comprising an elongated polyfoam pad having a cover of synthetic stretch fabric molded thereto and a cover of loop fastening material fastened to the opposite side of said polyfoam pad from said stretch fabric cover, and an elongated load control panel having hook fastening material fastened to one side thereof engaging said loop fastening material on each of said shoulder pads, said load control panels being stitched to said shoulder pads on one end thereof.

16. A shoulder harness in accordance with claim 15 wherein each said shoulder pad is generally S-shaped, and each said load control panel engaging one of said shoulder pads is correspondingly S-shaped.

17. A shoulder harness in accordance with claim 15 wherein stabilizing straps are provided which are connected between said upper and lower parts of said back panel and said stabilizing straps are fastened to said back control panels.

* * * * *